US010278439B2

(12) United States Patent
Jacks et al.

(10) Patent No.: US 10,278,439 B2
(45) **Date of Patent: *May 7, 2019**

(54) VARIABLE BOWTIE SYSTEM AND METHOD

(71) Applicant: ALLEN & LEE DESIGN, L.L.C., Ponchatoula, LA (US)

(72) Inventors: Richard A. Jacks, Hammond, LA (US); Walter L. Campbell, Jr., Hammond, LA (US)

(73) Assignee: ALLEN & LEE DESIGN, L.L.C., Ponchatoula, LA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/032,711

(22) Filed: Jul. 11, 2018

(65) Prior Publication Data

US 2018/0317581 A1 Nov. 8, 2018

Related U.S. Application Data

(63) Continuation-in-part of application No. 15/272,846, filed on Sep. 22, 2016, now Pat. No. 10,021,927.

(51) Int. Cl.

| | |
|---|---|
| ***A41D 25/04*** | (2006.01) |
| ***A41D 25/02*** | (2006.01) |
| ***A41D 25/00*** | (2006.01) |

(52) U.S. Cl.

CPC ..... *A41D 25/025* (2013.01); *A41D 25/005* (2013.01); *A41D 25/04* (2013.01); *A41D 2400/44* (2013.01)

(58) Field of Classification Search

CPC .... A41D 25/022; A41D 25/02; A41D 25/027; A41D 25/025

USPC ..... 2/151, 152.1, 154, 144

See application file for complete search history.

(56) References Cited

U.S. PATENT DOCUMENTS

| | | | | | |
|---|---|---|---|---|---|
| 1,531,230 | A | * | 3/1925 | Bernstein | A41D 25/025 2/151 |
| 2,411,908 | A | | 12/1946 | Taborski | |
| 2,420,387 | A | | 5/1947 | Taborski | |
| 2,421,972 | A | | 6/1947 | Taborski | |
| 2,450,741 | A | * | 10/1948 | Schreter | A41D 25/02 2/151 |
| 2,466,131 | A | | 4/1949 | Taborski | |
| 2,471,590 | A | * | 5/1949 | Southgate | A41D 25/02 2/151 |
| 2,777,131 | A | * | 1/1957 | Case | A41D 25/025 2/154 |
| 3,077,606 | A | * | 2/1963 | Less | A41D 25/027 2/154 |
| 3,115,640 | A | * | 12/1963 | Wiest | A41D 25/02 2/151 |

(Continued)

*Primary Examiner* — Gloria M Hale

(74) *Attorney, Agent, or Firm* — Keaty Law Firm LLC

(57) ABSTRACT

Variable bowtie system and method providing half-bows of different colors which can be chosen and combined, even layered, as desired by the user for one wearing, and with a different choice or combination of colors for another wearing. Chosen half-bow units of desired colors are placed on a mounting-stud pair affixed to a neckband, and are removably secured with a retaining collar, which may also be provided in a variety of colors, resulting in a bowtie having the desired color or color combination for a particular wearing, which can be changed upon another wearing.

12 Claims, 7 Drawing Sheets

(56) References Cited

U.S. PATENT DOCUMENTS

| | | | | | |
|---|---|---|---|---|---|
| 3,283,339 | A | * | 11/1966 | Heifetz | A41D 25/02 132/275 |
| 3,582,994 | A | * | 6/1971 | Sherman | A41D 25/02 2/154 |
| 3,728,737 | A | * | 4/1973 | Gillie | A41D 25/02 2/151 |
| 5,361,413 | A | * | 11/1994 | Schaefer | A41D 25/022 2/144 |
| 2014/0366243 | A1 | | 12/2014 | Ontiveros et al. | |
| 2015/0052659 | A1 | | 2/2015 | Talic | |
| 2015/0216243 | A1 | | 8/2015 | Graham | |
| 2016/0135523 | A1 | | 5/2016 | Ashmeade | |

* cited by examiner

VARIABLE BOWTIE SYSTEM AND METHOD

CROSS-REFERENCE TO RELATED APPLICATIONS

This application is a continuation-in-part of my application Ser. No. 15/272,846, filed on Sep. 22, 2016, now U.S. Pat. No. 10,021,927, issued on Jul. 17, 2018, the full disclosure of which is incorporated by reference herein and priority of which is hereby claimed.

BACKGROUND

The present invention provides for a system and method of a variable bowtie, the colors of the two halves of which can be chosen and combined as desired by the user for one wearing, and with a different choice or combination of colors for another wearing.

Bowties are a popular accessory, and may be worn in the most formal and the most informal settings. It is not unusual for both men and women to wear bowties. A bowtie, when worn, does not interfere with most activities, and can be worn without presenting danger of getting caught in or on other objects such as equipment, machines, or tools.

Wearing certain colors, and combinations of two or three colors taken together, on clothing is a common way of expressing support for an institution or a sports team, or to show membership or identification with a group, to express personal opinions, to acknowledge a holiday or a season, and sometimes simply to color-coordinate with other clothes. When combinations of colors are used for identification of an institution, team, or group, the specific hue, saturation, and value of each color are usually very important, where the wrong shade of a color may be considered inappropriate for a particular situation.

However, bowties presently available are made with only one, or very few, different textile materials of different colors. The chosen material might be a solid color, or might be a woven design or a printed design. The two halves of the bowtie, when worn, are typically of the same material and design, and accordingly look the same when worn. Even where the textile material has stripes or dots of different colors, those colors are seen in equal amounts on both halves of the bowtie. A self-tied bowtie can be made with different materials front and back, which gives a two-color effect when worn. A pre-tied or clip-on bowtie can be made with separate pieces of material, with the seams hidden behind the pre-tied knot, which allows a two-color effect.

But even if an existing bowtie is made in two colors, the bowtie will always feature only the same two colors every time it is worn. This limitation presents a problem to the person who wishes to wear a bowtie to express or show different things on different occasions. For example, at various times a person might want to show support for a red-and-white high school, a purple-and-gold college, a black-and-gold football team, a red-and-blue basketball team, a green-and-blue baseball team, a yellow-and-black social aid club, a red-and-green holiday season, a blue-and-gold state, and a red-white-and-blue nation, where different reds, greens, and blues are used by each entity. Representing more than one of the above situations would require the user to obtain multiple, separate bowties to cover all of these combinations. Further, each separate bowtie would only be useful for a single event or only a few times per year. It would require several separate presently available bowties to cover all of these combinations, and each separate bowtie would only be useful for one time or only a few times per year. It might be prohibitively expensive to acquire so many bowties, and it might require much time and effort to assemble such a collection.

U.S. Publication No. 2016/0135523, published by Andrew Hugh Ashmeade on May 19, 2016 for a "Spades Bowties," discloses a multi-modular product that introduces a new, easier way to assemble, disassemble, and reassemble a bowtie quickly while keeping the traditional look of a bowtie. The bow-flaps and center piece consist of different colors, texture, pattern, and fabrics that work simultaneously with one another. The bowtie system of the Ashmeade publication allows the consumer to arrange thirty-six different combinations of the bowtie. The system comprises a first bow-flap; a second blow-flap; a stabilizer configured to be positioned through each of the bow-flaps; and a neck strap to bind the pieces together. The neck strap is configured to retain the bow-flaps proximate at the user's neck, and a centerpiece is configured to selectively conceal the stabilizer and bow-flaps and bind to them to the neck strap.

U.S. Publication No. 2015/0052659 was published Feb. 26, 2015 by Yasmin Talic for "Selectively Interchangeable Neckties and Necktie Systems." The selectively interchangeable necktie system includes a bow member, a strap configured to retain the bow member proximate a user's neck, and a binder configured to selectively bind the bow member to the strap. In some examples, the selectively interchangeable necktie system includes a plurality of bow members. In some further examples, the neckties include bow members, straps, and binders with different complimentary or contrasting colors, patterns, and materials, so that the necktie system may be adaptable for the range of applications in which it will be employed.

U.S. Pat. No. 2,466,131 issued on Apr. 5, 1949 to Alfred F. Taborski for a "Novelty Necktie." The object of the Taborski invention is to provide an improved novelty display device, and particularly an improvement of a display device which may be detachably secured to garments. In the invention, generally flat wing elements are detachably connected to a base member so as to be interchangeable, and assembled on the base member with either face of each forward. The faces of these flat wing elements may carry pictures, words, symbols, or other information to be displayed. The display device may be worn as a necktie or pinned to any part of a garment, and is designed to be simple, light in weight, attractive, and novel in appearance, and also relatively inexpensive so that it may be discarded in part or in entirety when its purpose has been served.

U.S. Pat. No. 2,421,972 also issued to Alfred F. Taborski, on Jun. 10, 1947 for a "Bow Tie." The bow tie invention provided a new and useful improvement in bow ties embodying interchangeable wing members adapted for detachable engagement with the knot structure of the tie. In the invention, the wings may be removed and replaced when desired and thus enable wing portions of the tie with various colors to be connected to the knot structure. The Taborski bow tie covers an article of manufacture including a tubular simulated knot structure and a pair of separable and replaceable wing members; a rigid member carried at the end of each of said wing members, where the rigid members each have a transverse disc portion at its outer end; and a tube in the knot structure having incomplete annular flanges at its opposite ends, each flange merging cooperatively with a lateral slotted end portion of the tube. The respective slots are each of a width corresponding to the diameter of the disc portion of the rigid member at the end of the correlated wing members, so as to enable frictional gripping engagement of the respective disc members with the flange portions of the knot structure tube. Opposed spring-urged members carried within the tube of the knot structure are provided for clamping the disc portions of the wing members against the flanges of the tube of the knot structure.

U.S. Pat. No. 2,420,387, also invented by Alfred F. Taborski, issued on May 13, 1947 for a "Preformed Necktie." The preformed necktie provides an improved novelty necktie with which different visual effects in appearance may be obtained in the same tie by suitable manipulation. The necktie comprises a knot portion having collar attaching means and wings detachably connected to the knot portion so as to extend endwise therefrom. Each wing is rotatable relative to the knot portion about an axis extending lengthwise of the portion, and is also individually detachable from the knot portion. Either wing may be rotated relatively to the knot portion to present either of its faces forwardly, or detached to be replaced by a similar wing with a different appearance. The preformed necktie also provides for an embodiment in which one of the wings is in the form of a bellows, expansible and contractible at its free end, containing a spring within the bellows, whereby a sound device connected to the wing is operative to emit a sound upon movement of the spring in one direction.

U.S. Pat. No. 2,411,908 was also issued to Alfred F. Taborski, on Dec. 3, 1946 for a "Bow Tie." In this invention, the primary object is to provide foldable wing portions hingedly connected at the knot portion of the tie, as well as means for the tie to be folded into a compact form for conveniently carrying in a pouch, container, or pocket of the wearer. The concept provides a hinge structure forming the knot portion of the tie, formed with a plurality of sockets in each of the hinge members to removably receive the ends of rigid strips carried by the wing portions of the tie. The wing portions may be formed of a plurality of piles of material of various colors, whereby the individual piles of material may be individually removed, and other piles of material of different colors may be interchangeably substituted. In this manner, the several piles of material forming the wing members may be replaced should the wing members become soiled or worn, or if a different combination of colors is desired by the wearer.

U.S. Publication No. 2015/0216243 was published Aug. 6, 2015 by Drew Storm Graham and discloses an "Interchangeable Bow Tie." One embodiment of the interchangeable bow tie consists of wings joined to a knot. The wings are interchangeable and affixed to the knot through a tongue in a groove fit, and are further secured to the knot through the magnetic attraction of magnets embedded in the knot to magnets embedded in the wings. The magnets embedded in the knot and wings are of a small, standard design. All of the magnets have their north poles facing the same direction relative to the front and back surfaces of the knot. The use of these standard magnets, and their consistent placement on the knot and wings with their north poles facing the same direction, facilitates the manufacture of knots and wings of a simple design that can be produced in small quantities at a low cost.

U.S. Publication No. 2014/0366243 was published Dec. 18, 2014 by Immanuel David Ontiveros et al., disclosing "Multi-Part Bow Ties." The bow ties include at least a proximal panel that can easily be detached from a distal panel. The proximal and distal panels can be made from different fabrics, fabrics having different colors and/or patterns, and so forth, and thus enable a user to create bow ties wherein the distal and proximal panels have a different appearance. Preferably, each panel represents one-half, or less, of a bow tie, and includes the proximal and distal portions. Depending upon the type of bow tie (for example, a double-ended type or a single-ended type), the proximal portions are typically those that are seen when a bow tie is worn, and which are looped or tied about each other when tying a bow tie. The distal portion generally refers to the portion of a bow tie panel that associates with a shirt collar, when the shirt is worn under the bow tie, and which is used to connect the panel to another bow tie panel that has a complementary connector at its distal end.

SUMMARY OF THE INVENTION

The present invention provides for a system and method of a variable bowtie providing half-bows of different colors, which can be chosen and combined as desired by the user for one wearing, and with a different choice or combination of colors for another wearing, where chosen half-bow units of desired colors are placed on a mounting-stud pair affixed to a neckband, and are removably secured with a retaining collar, which may also be provided in a variety of colors, resulting in a bowtie having the desired color or color combination for a particular wearing, which can be changed upon another wearing.

This invention provides a way to enable the wearing of a bowtie on many occasions with the bowtie having the desired different colors and color combinations for each separate occasion, without having to acquire a large number of separate bowties.

BRIEF DESCRIPTION OF DRAWINGS

Reference will now be made to the drawings, wherein like parts are designated by like numerals, and wherein.

DETAILED DESCRIPTION OF THE INVENTION

Referring to all figures generally, embodiments of the variable bowtie 10 system and method are illustrated.

Figure 1:
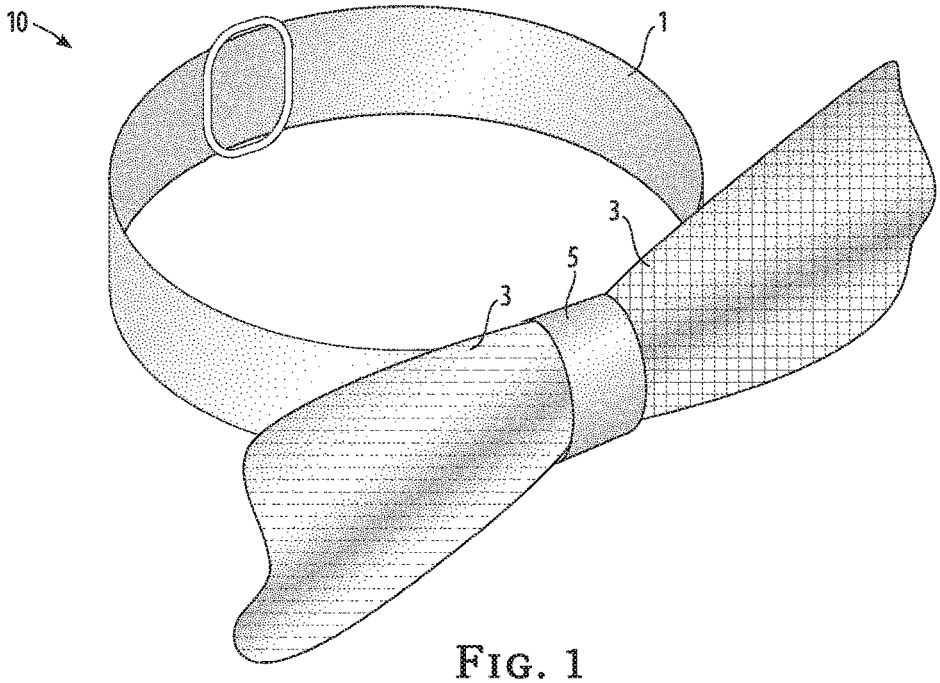
FIG. 1 is a perspective view of the variable bowtie in use in an embodiment having half-bow units as the base.
Figure 2:
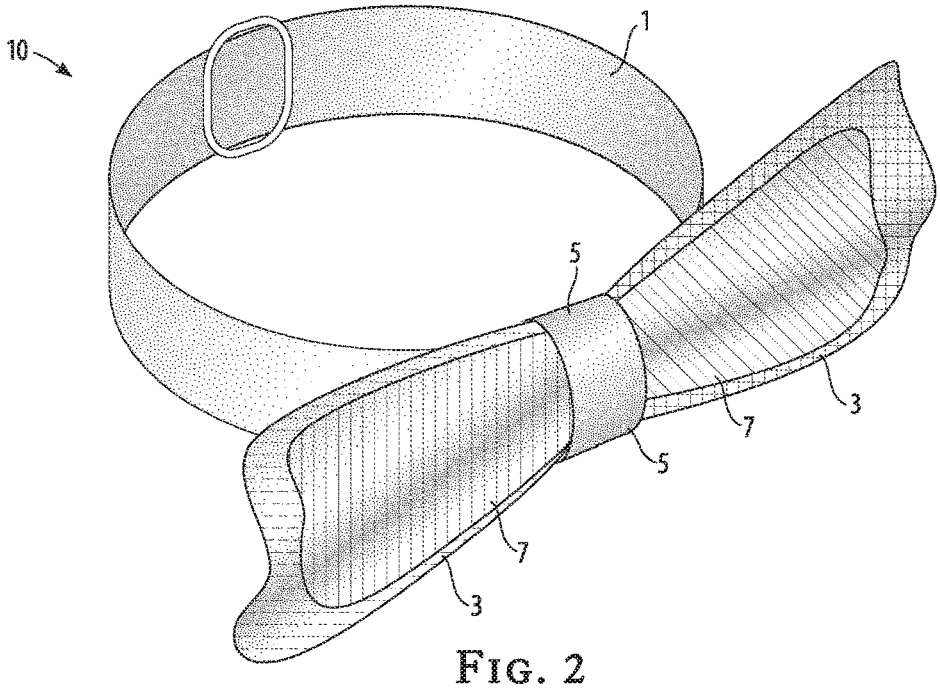
FIG. 2 is a perspective view of the variable bowtie in use in an embodiment having half-bow units as the base and mid-half-bow units thereon.
Figure 9:
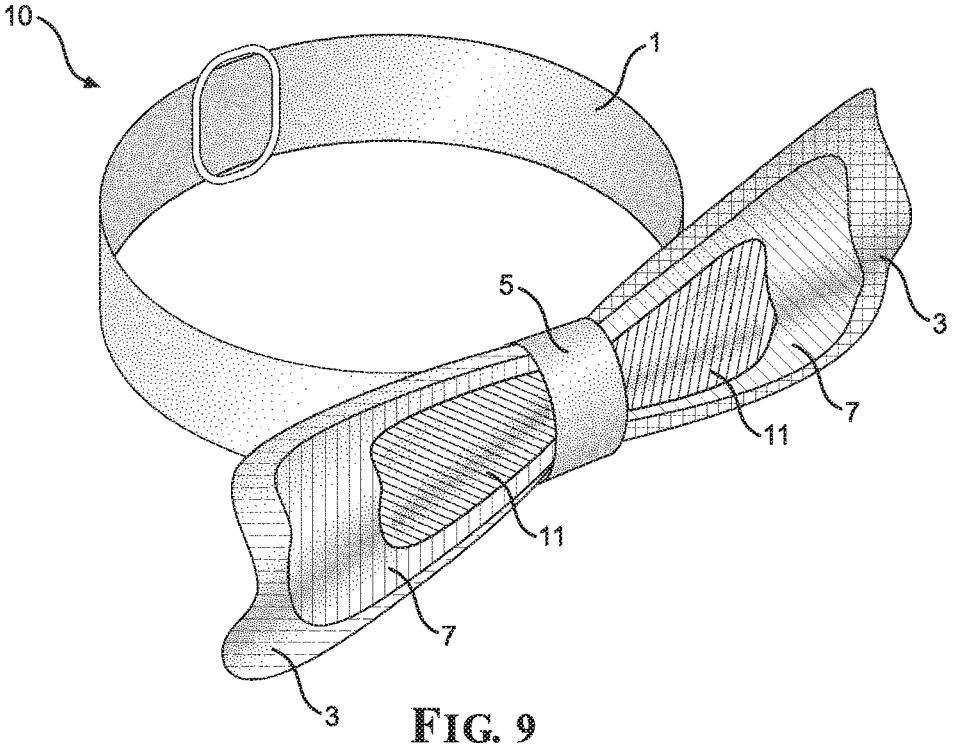
FIG. 9 is a perspective view of the variable bowtie in use in an embodiment having half-bow units as the base and mid-half-bow units and front-half-bow units thereon.

Referring to FIG. 1, FIG. 2, and FIG. 9, the variable bowtie 10 system and method provides a user with the ability to create a bowtie having a desired color or color combination for any given wearing. Upon the neckband 1 are placed two base-half-bow units 3, and optionally either two mid-half-bow units 7 or two front-half-bow units 11 or both, which are held in place by a retaining collar 5. When used in conjunction with optional mid-half bow units 7 or front-half-bow units 11, the base-half-bow units 3 serve as a base unit by relative size. The size distinctions of base-half-bow units 3, mid-half-bow units 7, and front-half-bow units 11 are relative to each other so that mid-half-bow units 7 are smaller than base-half-bow units 3 while front-half-bow units 11 are smaller than mid-half-bow units 7 as well as base-half-bow units 3. The mid-half-bow unit 7 may serve in the front of the bowtie system 10 in the absence of front-half-bow units 11. Therefore, the bowtie system 10 may optionally appear single, double, or triple layered as shown in FIG. 1, FIG. 2, and FIG. 9, respectively. The base-half-bow units 3, and optional mid-half-bow units 7 as well as optional front-half-bow units 11, are provided in a variety of colors, allowing the user to choose colors and color combinations for a particular wearing, and to choose other colors and combinations for other wearing's. The neckband 1 may be a common neckband for all occasions, or a neckband provided in a variety of colors. The retaining collar 5 may be a common collar for all occasions, or a collar provided in a variety of colors. The neckband 1 will not always be visible when in use, but the retaining collar 5 will be visible.

Figure 3:
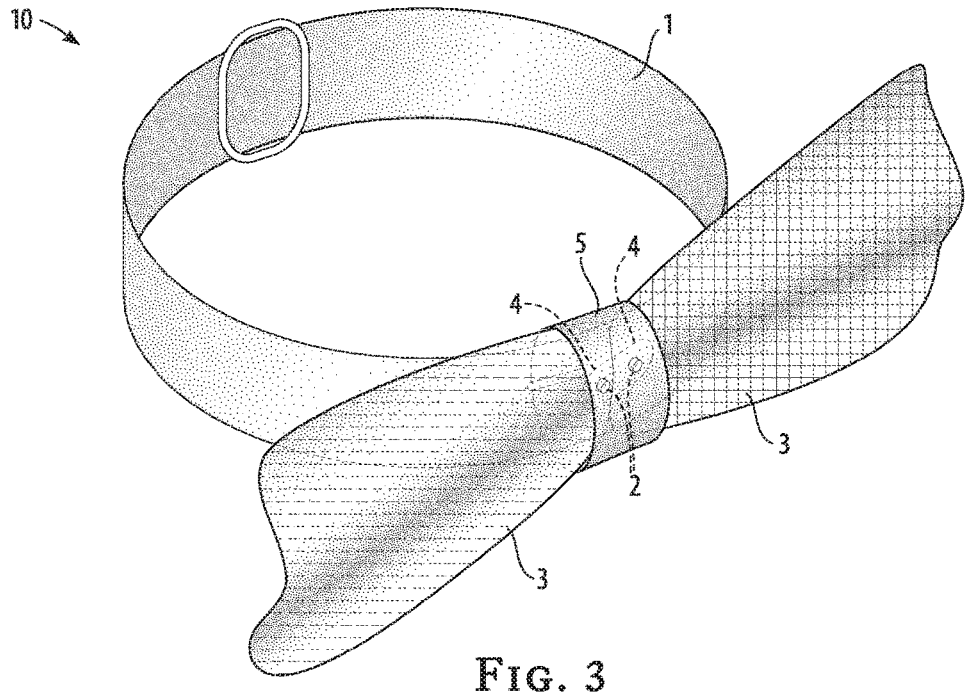
FIG. 3 is a perspective view showing hidden elements of the variable bowtie in use in an embodiment having half-bow units as the base.
Figure 4:
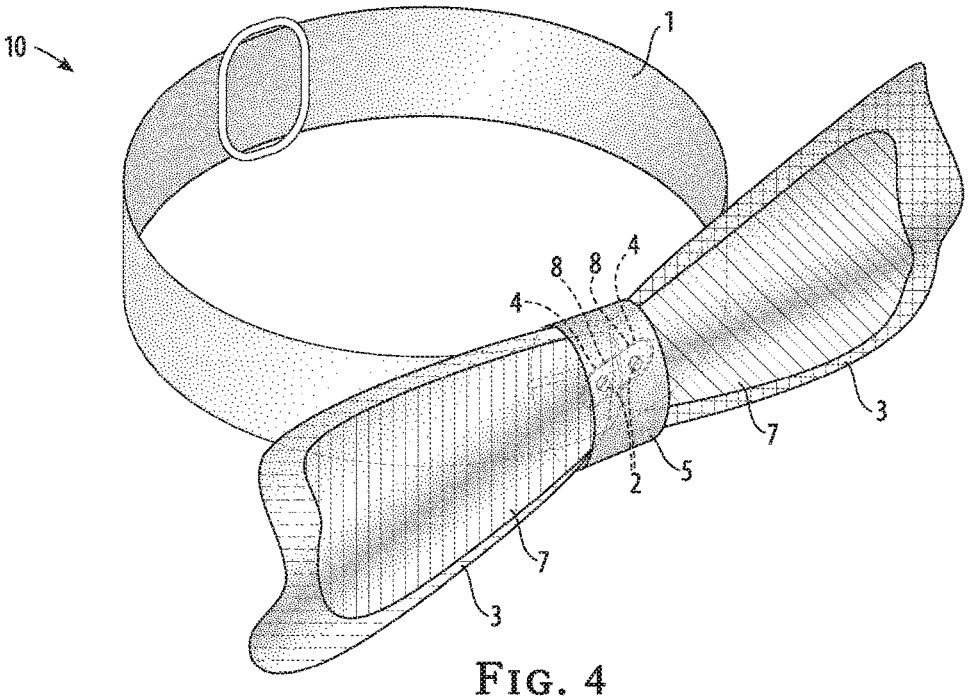
FIG. 4 is a perspective view showing hidden elements of the variable bowtie in use in an embodiment having half-bow units as the base and mid-half-bow units thereon.
Figure 10:
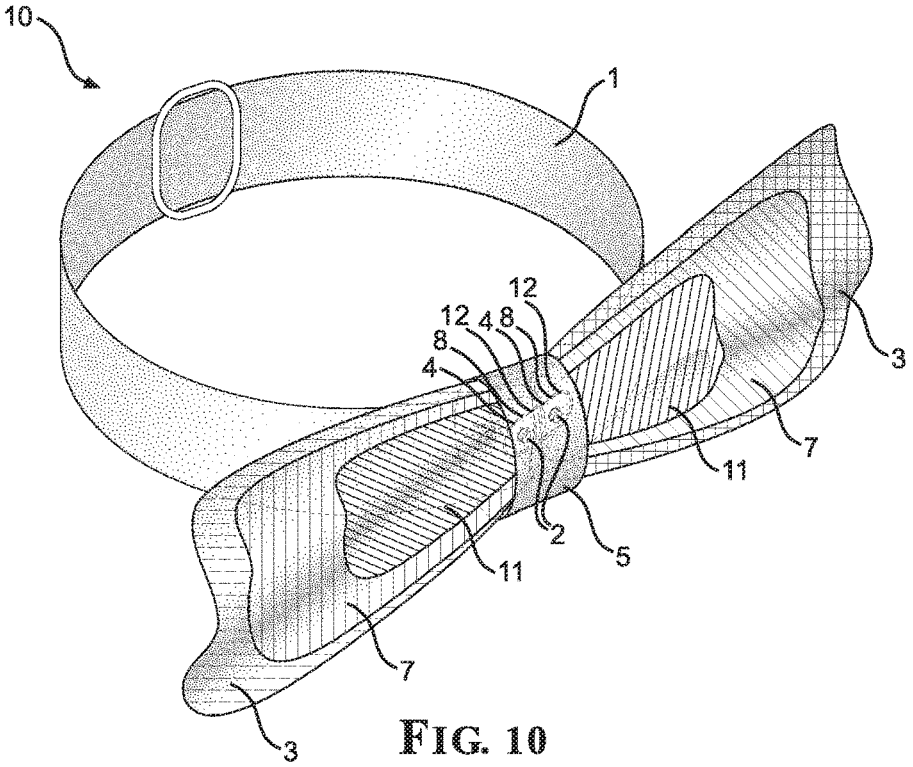
FIG. 10 is a perspective view showing hidden elements of the variable bowtie in use in an embodiment having half-bow units as the base and mid-half-bow units and front-half-bow units thereon.

Referring to FIG. 3, FIG. 4, and FIG. 10, the neckband 1 has a mounting-stud pair 2 affixed to it in a location corresponding the front of the neck of the wearer when in use, which essentially corresponds to the location of a top front button, when buttoned, on a collared shirt. Each base-half-bow unit 3 has a unit tab extension 4 located, as illustrated, on the together-facing edge of the base-half-bow unit 3. Two holes matched in size and spacing to the mounting-stud pair are placed, one in the unit tab extension 4 and one in the base-half-bow unit 3 near the together-facing edge, and therefore to the unit tab extension 4. The two holes are placed such that the base-half-bow unit 3 is removably fixed in relationship to the neckband 1 and to the other base-half-bow unit 3. As shown in FIG. 10, each optional mid-half-bow unit 7 and optional front-half-bow unit 11 has essentially the same structure, but at a smaller size or scale as the base-half-bow unit 3, with the optional front-half-bow unit 11 being the smallest in size. The optional front-half-bow unit 11 has a front-unit tab 12 shown in FIG. 10. The mid-half bow unit 7 is also fitted with a mid-unit tab 8 shown in FIG. 4. In the preferred embodiment of the present invention, the front-half-bow unit 11 is meant to be worn in front of the mid-half-bow unit 7, which is meant to be worn in front of the base-half-bow unit 3, so that the colors of all units are seen. However, in alternate embodiments of the invention the base-half-bow units 3, the optional mid-half-bow units 7 and the optional front-half-bow units 11, may be placed in any order or pairing.

Figure 5:
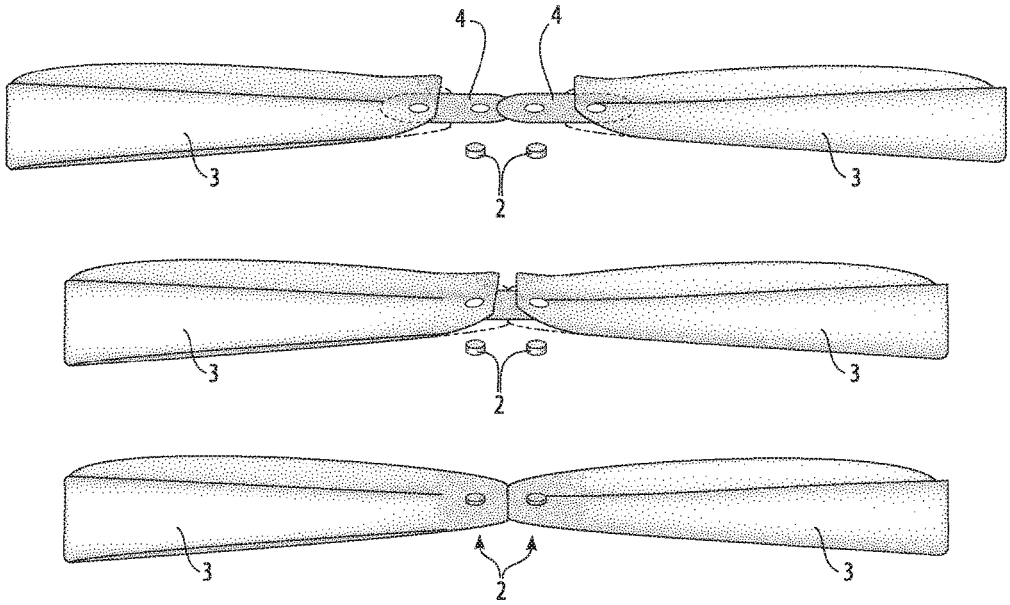
FIG. 5 shows the mounting of two half-bow units.

Referring to FIG. 5, the base-half-bow unit 3 and optional mid-half-bow 7 and optional front-half-bow unit 11 are made of textile materials of various colors, where each unit has, at a minimum, a front face or layer and a back face or layer relative to the in-use position. It is possible to have additional layers, such as lining or stiffening fabrics, between the front and back layers. The unit tab 4 and mid-unit tab 8 and front-unit tab 12 are attached to the together-facing edge of the half-bow unit 3. A portion of the together-facing edge is left with the front layer and back layer not attached, forming a pocket. In use, when two base-half-bow units 3 are brought together, the unit tab 4 can be fit into that pocket, hiding the unit tab 4 behind the front layer of the other base-half-bow unit 3. In use, one of the unit tabs 4 will fit behind the back layer of the other base-half-bow unit 3, and the other unit tab 4 will fit into the pocket of the first base-half-bow unit 3.

Figure 6:
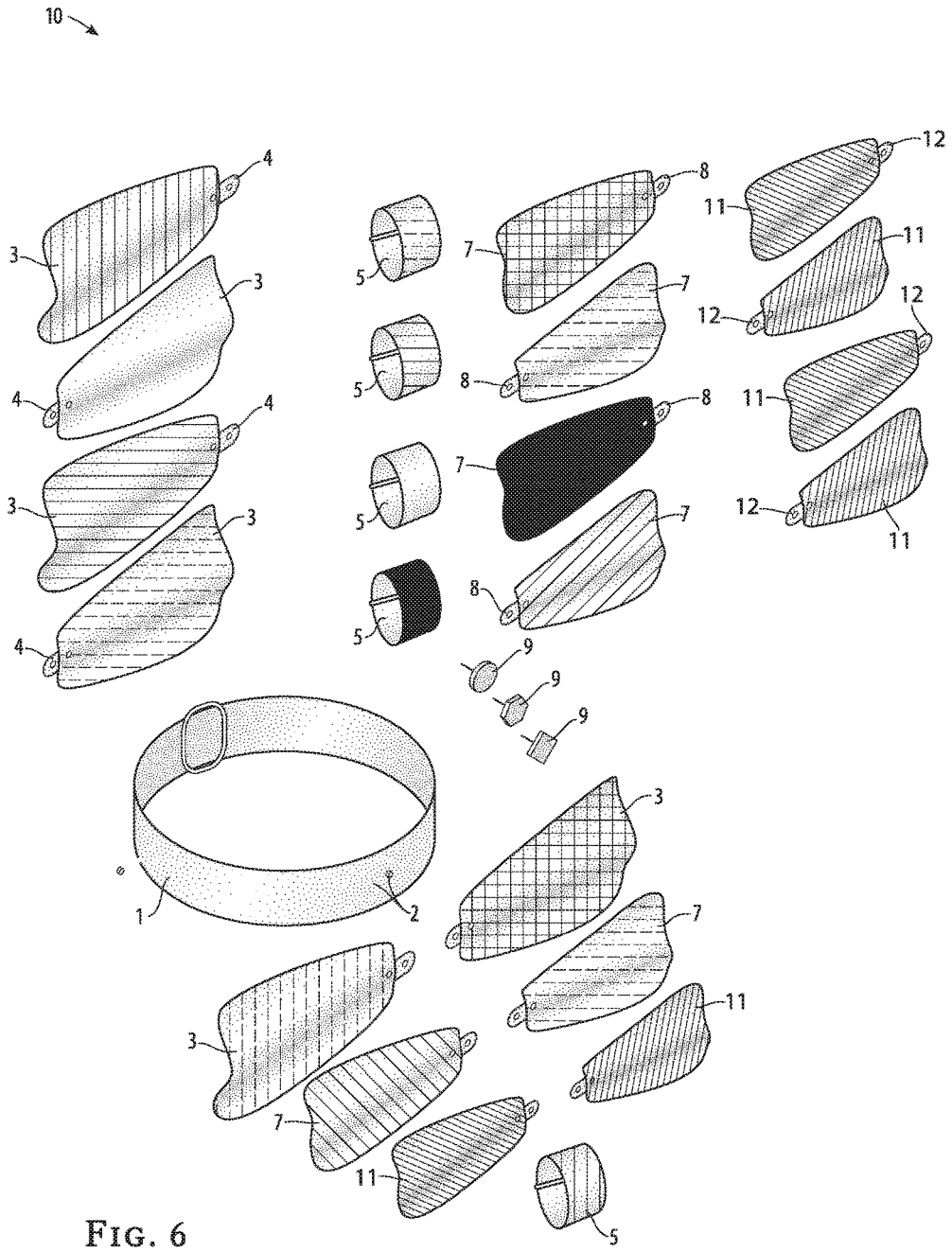
FIG. 6 shows the elements and optional mid-half bow units and front-half-bow units of the variable bowtie system and method.

Referring to FIG. 6, the variable bowtie 10 is meant to be provided in a variety of colors of base-half-bow units 3 and optional mid-half-bow units 7 and/or front-half-bow units 11, so that the user can choose different colors and color combinations as desired for a given wearing. Optionally, the retaining collars 5 can be provided in a variety of colors, giving the user additional choices. Optionally, one or more decorative pins 9 can be provided.

Figure 7:
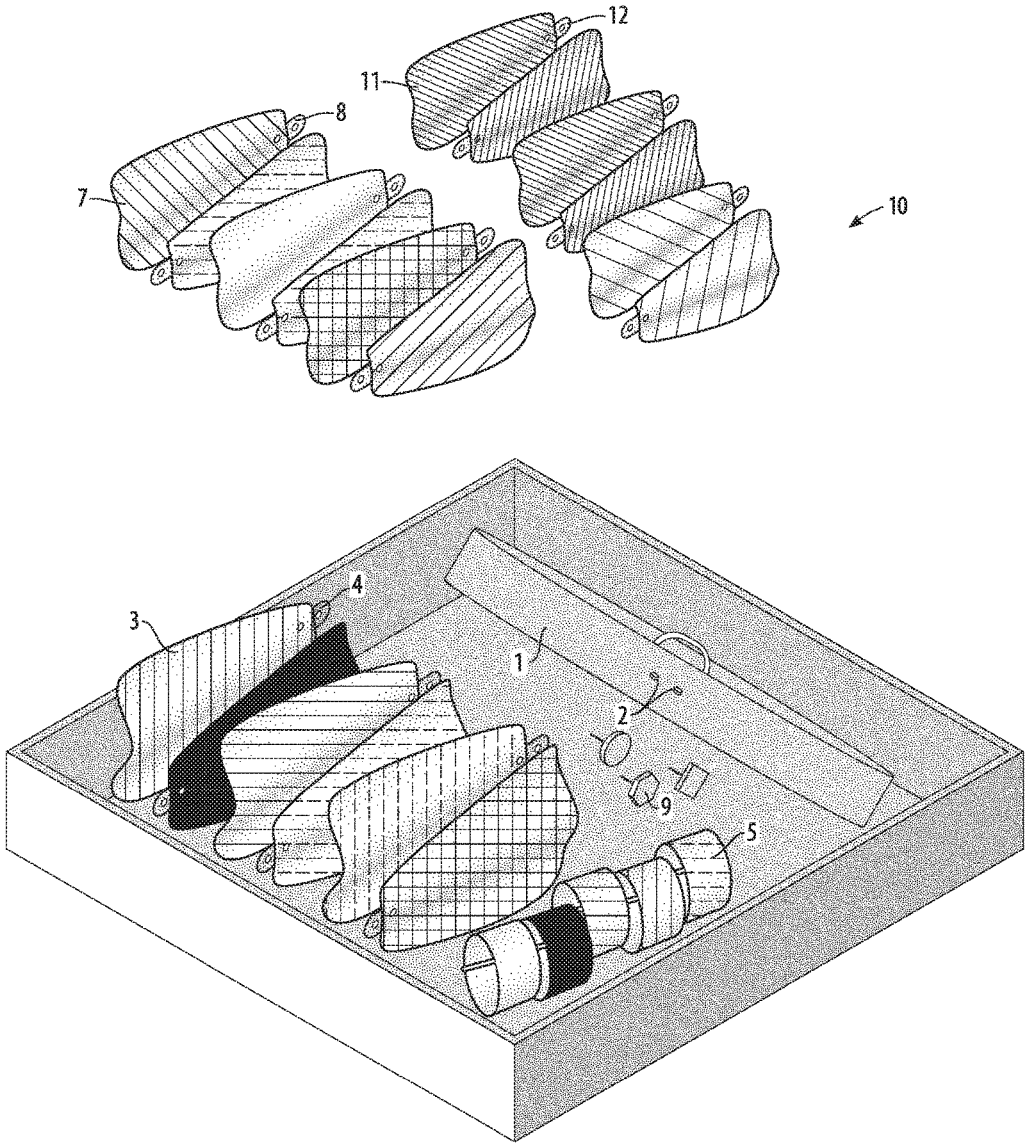
FIG. 7 shows the provision of an embodiment of the variable bowtie in a kit.

Referring to FIG. 7, the variable bowtie 10 can be provided in kit form.

Figure 8:
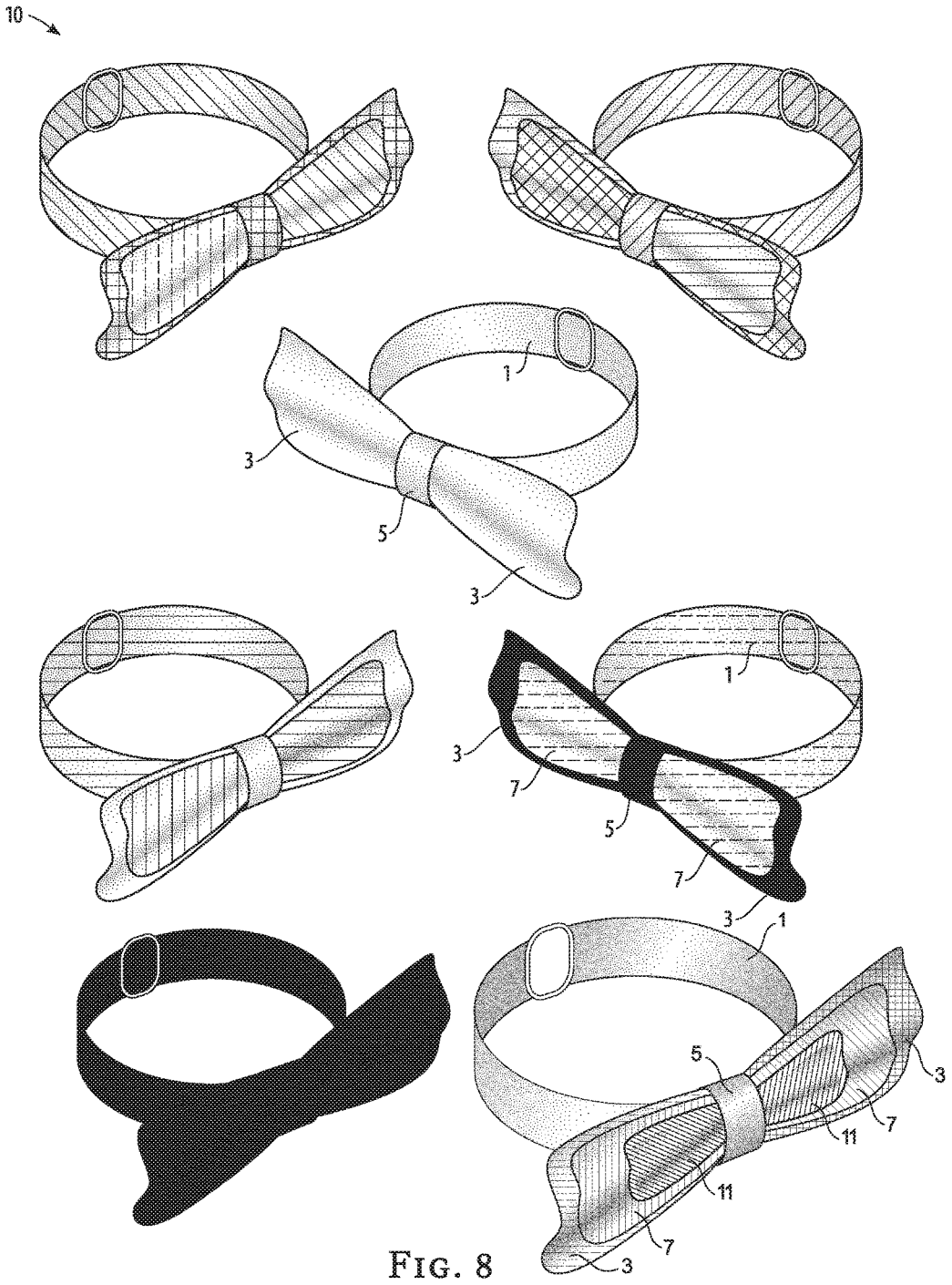
FIG. 8 shows examples of different colors and color combinations in use of the variable bowtie.

Referring to FIG. 8, the variable bowtie 10 system and method allows the wearing of several different colors and color combination, using and re-using common elements, and combining and re-combining elements of various colors.

Many changes and modifications can be made in the present invention without departing from the spirit thereof. We therefore pray that rights to the present invention be limited only by the scope of the appended claims.

We claim:

1. A variable bowtie system, comprising:

(i) a neckband adapted to adjustably fit around a neck of a person, wherein said neck has a nominal forward portion, and said neckband has, in use, a forward-facing portion corresponding to a location that in turn corresponds to a position of a top front shirt button featured at the forward portion of the neck;

(ii) a mounting-stud pair affixed to said neckband at the forward-facing portion of the neckband and protruding forward;

(iii) at least two base-half-bow units, each having at least two layers of textile material comprising a front face and a back face, and each said layer having a together-facing edge which comes in closest proximity to another base-half-bow unit when in use, where the front face and the back face of each said base-half-bow unit, at the together-facing edge, are left partially detached, forming a pocket at the together-facing edge, and a base-unit tab extension affixed to the back face of the together-facing edge of each said base-half-bow unit, adapted to fit into the pocket at the together-facing edge of another said half-bow unit;

(iv) at least two mid-half-bow units each at a smaller size than said base-half-bow units and having a structure matching said base-half-bow units, wherein said matching structure comprises at least two layers of textile material comprising a front face and a back face, and each said layer having a together-facing edge which comes in closest proximity to another mid-half-bow unit when in use, where the front face and the back face of each said mid-half-bow unit, at the together-facing edge, are left partially detached, forming a pocket at the together-facing edge, and each said mid-half-bow unit adapted to be mounted in front of said base-half-bow units, and a mid-unit tab extension affixed to the back face of the together-facing edge of each said mid-half-bow unit, adapted to fit into the pocket at the together-face edge of another said mid-half-bow unit;

(v) at least two front-half-bow units each at a smaller size than said base-half-bow units and mid-half-bow units and having a structure matching said base-half-bow units and mid-half-bow units, wherein said matching structure comprises at least two layers of textile material comprising a front face and a back face, and each said layer having a together-facing edge which comes in closest proximity to another front-half-bow unit when in use, where the front face and the back face of each said front-half-bow unit, at the together-facing edge, are left partially detached, forming a pocket at the together-facing edge, and each said front-half-bow unit adapted to be mounted in front of said mid-half-bow units, and a front-unit tab extension affixed to the back face of the together-facing edge of each said front-half-bow unit, adapted to fit into the pocket at the together-face edge of another said front-half-bow unit;

(vi) one hole placed in each said half-bow unit near the together-facing edge and another hole placed in each said unit tab extension, such that the holes together are adapted to fit over said mounting-stud pair;

where, in use, said half-bow units are brought together at the together-facing edges in such a way that one of the unit tab extensions is positioned behind the back face of the other said half-bow unit, and the other unit tab extension is positioned inside the pocket of the other half-bow unit, where the forward-most unit tab extension is concealed behind the front face of the other half-bow unit; and (vii) at least one retaining collar adapted to fit around, and hold together, the assembled together-facing edges of said half-bow units, said mounting-stud pair, and said neckband;

where said half-bow units and said retaining collars are provided in a variety of colors, allowing the person to choose specific colors and combinations and to change such colors and combinations as desired.

2. The variable bowtie system of claim 1, further comprising at least one decorative pin adapted to being removably placed into and upon said retaining collar.

3. The variable bowtie system of claim 1, further comprising a kit comprising at least one said neckband, at least two said base-half-bow units, at least two said mid-half-bow units, at least two said front-half-bow units, and at least one said retaining collar.

4. The variable bowtie system of claim 1, further comprising a kit comprising at least one said neckband, at least two said base-half-bow units, at least two said mid-half-bow units, at least two said front-half-bow units, at least one said retaining collar, and at least one decorative pin adapted to being removably placed into and upon said retaining collar.

5. The variable bowtie system of claim 1, where said half-bow units, said retaining collars, and said neckband are provided in a variety of colors suitable for the wearing of several different color combinations as desired by the user.

6. The variable bowtie system of claim 1, further comprising a kit comprising at least one said neckband, at least one said retaining collar, and several said half-bow units, where said half-bow units, said retaining collars, and said neckband are provided in a variety of colors suitable for the wearing of several different color combinations as desired by the user.

7. A variable bowtie method, comprising:

(i) providing a variable bowtie system, comprising:

(a) a neckband adapted to adjustably fit around a neck of a person, wherein said neck has a nominal forward portion, and said neckband has, in use, a forward-facing portion corresponding to a location that in turn corresponds to a position of a top front shirt button at the forward portion of the neck;

(b) a mounting-stud pair affixed to said neckband at the forward-facing portion of the neckband and protruding forward;

(c) at least two base-half-bow units, each having at least two layers of textile material comprising a front face and a back face, and each said layer having a together-facing edge which comes in closest proximity to another base-half-bow unit when in use, where the front face and the back face of each said base-half-bow unit, at the together-facing edge, are left partially detached, forming a pocket at the together-facing edge, and a base-unit tab extension affixed to the back face of the together-facing edge of each said base-half-bow unit, adapted to fit into the pocket at the together-facing edge of another said half-bow unit;

(d) at least two mid-half-bow units each at a smaller size than said base-half-bow units and having a structure matching said base-half-bow units, wherein said matching structure comprises at least two layers of textile material comprising a front face and a back face, and each said layer having a together-facing edge which comes in closest proximity to another mid-half-bow unit when in use, where the front face and the back face of each said mid-half-bow unit, at the together-facing edge, are left partially detached, forming a pocket at the together-facing edge, and a mid-unit tab extension affixed to the back face of the together-facing edge of each said mid-half-bow unit, adapted to fit into the pocket at the together-face edge of another said mid-half-bow unit;

(e) at least two front-half-bow units each at a smaller size than said base-half-bow units and mid-half-bow units and having a structure matching said base-half-bow units and mid-half-bow units, wherein said matching structure comprises at least two layers of textile material comprising a front face and a back face, and each said layer having a together-facing edge which comes in closest proximity to another front-half-bow unit when in use, where the front face and the back face of each said front-half-bow unit, at the together-facing edge, are left partially detached, forming a pocket at the together-facing edge, and a front-unit tab extension affixed to the back face of the together-facing edge of each said front-half-bow unit, adapted to fit into the pocket at the together-face edge of another said front-half-bow unit;

(f) one hole placed in each said half-bow unit near the together-facing edge and another hole placed in each said unit tab extension, such that the holes together are adapted to fit over said mounting-stud pair; and (g) at least one retaining collar adapted to fit around, and hold together, the assembled together-facing edges of said half-bow units, said mounting-stud pair, and said neckband;

where said half-bow units and said retaining collars are provided in a variety of colors, allowing the person to choose specific colors and combinations and to change such colors and combinations as desired;

(ii) bringing two half-bow units together at the together-facing edges in such a way that one of the unit tab extensions is positioned behind the back face of the other said half-bow unit, and the other unit tab extension is positioned inside the pocket of the other half-bow unit, where the forward-most unit tab extension is concealed behind the front face of the other half-bow unit;

(iii) placing said brought-together half-bow units upon said mounting-stud pair; placing said retaining collar over the together-facing edges of said half-bow units and over said mounting-stud pair; and (iv) disassembling said variable bowtie after wearing, for re-assembly with different colors and color combinations in the future.

8. The variable bowtie method of claim 7, where said variable bowtie system further comprises at least one decorative pin adapted to being removably placed into and upon said retaining collar.

9. The variable bowtie method of claim 7, where said variable bowtie system further comprises a kit comprising at least one said neckband, at least two said base-half-bow units, at least two said mid-half-bow units, at least two said front-half-bow units, and at least one said retaining collar.

10. The variable bowtie method of claim 7, where said variable bowtie system further comprises a kit comprising at least one said neckband, at least two said base-half-bow units, at least two said mid-half-bow units, at least two said front-half-bow units, at least one said retaining collar, and at least one decorative pin adapted to being removably placed into and upon said retaining collar.

11. The variable bowtie method of claim 7, where said half-bow units, said retaining collars, and said neckband are provided in a variety of colors suitable for the wearing of several different color combinations as desired by the user.

12. The variable bowtie method of claim 7, where said variable bowtie system further comprises a kit comprising at least one said neckband, at least one said retaining collar, and several said half-bow units, where said half-bow units, said retaining collars, and said neckband are provided in a variety of colors suitable for the wearing of several different color combinations as desired by the user.

* * * * *